United States Patent [19]

Sunnen et al.

[11] Patent Number: 4,486,983

[45] Date of Patent: Dec. 11, 1984

[54] GUIDES FOR HONING HEADS

[75] Inventors: Robert M. Sunnen, Frontenac; Duane W. Woltjen, Manchester, both of Mo.

[73] Assignee: Sunnen Products Company, St. Louis, Mo.

[21] Appl. No.: 415,488

[22] Filed: Sep. 7, 1982

[51] Int. Cl.[3] ..... B24B 9/02

[52] U.S. Cl. ..... 51/347

[58] Field of Search ..... 51/347, 348, 349, 350, 51/351

[56] References Cited

U.S. PATENT DOCUMENTS

| | | | |
|---|---|---|---|
| 1,562,587 | 11/1925 | Ranagan | 51/351 |
| 1,902,194 | 3/1933 | Sunnen | 51/347 |
| 2,020,589 | 11/1935 | Sunnen | 51/347 |
| 2,348,132 | 5/1944 | Hyland | 51/351 |
| 2,445,492 | 7/1948 | Pentecost | 51/350 |
| 3,800,482 | 4/1974 | Sunnen | 51/351 |

*Primary Examiner*—Frederick R. Schmidt
*Assistant Examiner*—J. T. Zatarga
*Attorney, Agent, or Firm*—Haverstock, Garrett & Roberts

[57] ABSTRACT

An improved guide assembly for a honing mandrel including an elongated support member having opposite surfaces and spaced side edges, the contour of the elongated member being such that portions of the elongated member are able to flex relative to each other, at least two elongated parallel rack gear members having corresponding ends connected at spaced locations to extend in parallel relation extending perpendicularly from one of the opposite surfaces of the elongated member, and an elongated work engaging member having a first portion positioned adjacent to the elongated support member on the surface thereof opposite from which the rack gears extend and a second portion extending outwardly from the first portion for engaging a surface to be honed, and means connecting the work engaging member to the elongated member. The subject guide assembly may also include a construction wherein the support member has two separate portions each independently angularly movable relative to the other and to the portions of the support member to which the rack gears are attached, a separate elongated work engaging member being attached to each independently movable portions of the support member.

11 Claims, 10 Drawing Figures

GUIDES FOR HONING HEADS

PRIOR ART

It has been common practice in the past to construct honing heads or honing mandrels having body portions with a central pinion gear rotatably mounted therein, and wherein a plurality, usually four, work engaging assemblies are mounted for radial movement on the body, and each includes rack gear portions which cooperatively engage the pinion gear and work engaging portions which engage a work surface to be honed. Typical of such constructions are the constructions shown in Sunnen U.S. Pat. Nos. Re 18,763; 1,929,613; 1,946,041; 1,982,836; 2,002,649; 2,020,589; 2,040,281 and 3,378,962. In the prior art constructions, it has been the usual practice to use a symmetrical arrangement of the work engaging members, usually arranged in opposed pairs, wherein one of the pairs is formed by assemblies with honing stones thereon and the other opposed assemblies have relatively non-abrasive work engaging members or guide members thereon. In the prior art all of the work engaging assemblies are moved radially at the same rate, by the same pinion gear, and by rack gears having identical teeth to advance all of the work engaging members equally into engagement with the work surface or to equally retract all of the work engaging members in order to facilitate installing and removing the honing head from the work. In one conventional construction it has been the usual practice to have a single stone member or a single guide member mounted on each of the work engaging assemblies and to have the stone assemblies arranged in a diametrially opposed pair and to have the guide assemblies arranged in a diametrically opposed pair at locations on the work surface circumferentially spaced between the stone assemblies. Another construction contains two circumferentially spaced honing stones mounted on each of two diametrically opposed holders and two circumferentially spaced guide members on each of two diametrically opposed guide assemblies. Stones and guides mounted in this manner are currently used to hone bores which have interruptions in them such as splines and keyways. In the prior art constructions the work engaging stone or guide members has been mounted on one side of a one-piece relatively rigid backing member which have rack gears attached to their opposite sides. However, it is discovered that such constructions generate substantial objectionable noise, vibration and chatter, and these undesirable conditions increase especially when operated with relatively heavy pressure placed on the stones.

The present construction overcomes these and other disadvantages and shortcomings of the known constructions by teaching the use of masterholders as parts of honing and guide assemblies and more importantly the use of masterholders for guide assemblies which are able to flex and yet remain resilient. Such masterholders must be able to flex over a considerable distance so as not to become rigid or to bottom when limited available spring travel is reached or exceeded as happens with existing spring loaded guides. It is also found that it is preferred to use an assembly construction for the stone and guide assemblies that is somewhat similar to the constructions shown in pending Sunnen U.S. patent application Ser. No. 314,856, filed Oct. 26, 1981, and assigned to applicant's assignee. The assembly constructions shown in the pending case all include a master stone holder member, usually of hardened steel, and a member attached thereto, usually of some material such as zinc, to which the stones are attached. In the case of the guide assemblies the work engaging portions may also be of zinc attached directly to hardened steel masterholders. It has been discovered that such a construction substantially reduces the noise, vibration and chatter associated with previous designs and achieves substantially improved honing accuracies and faster stock removal rates.

It is therefore a principal object of the present invention to increase the honing rate and honing accuracy and reduce the noise of honing devices.

Another object is to teach the use of a honing mandrel having work engaging members, at least some of which are mounted on assemblies that include masterholders with work engaging support members attached thereto.

Another object is to teach the use of relatively resilient masterholders for use under work engaging guide members in order to provide some flexing action therefor.

Another object is to reduce noise, vibration and chatter associated with honing devices.

Another object is to provide an improved honing mandrel that can be used on existing honing machines without requiring modification thereof.

Another object is to provide an improved honing device that can be operated by persons having relatively little skill and training.

These and other objects and advantages of the present invention will become apparent after considering the following detailed specification of preferred embodiments thereof in conjunction with the accompanying drawings, wherein.

Figure 1:
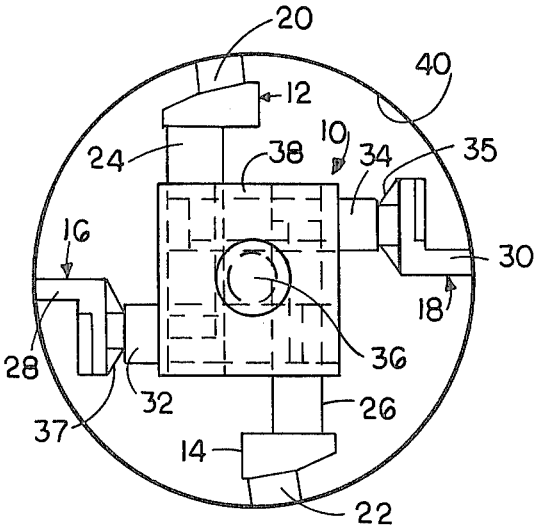
FIG. 1 is a cross-sectional view through a conventional honing mandrel assembly having pinion driven work engaging members mounted thereon.

Referring to the drawings more particularly by reference numbers, number 10 in FIG. 1 identifies a honing mandrel of conventional construction, which mandrel includes two similar diametrically opposite honing assemblies 12 and 14 and two similar diametrically opposite guide assemblies 16 and 18. The honing assemblies 12 and 14 include respective honing stones 20 and 22 and respective rack gear members 24 and 26. The guide assemblies 16 and 18 include respective work engaging relatively non-abrasive members 28 and 30 which are able to articulate relative to respective rack gears 32 and 34 by compressing curved spring steel members 35 and 37. The rack gears 24, 26, 32 and 34 all have similar rack gear teeth which cooperatively engage the teeth of a centrally located pinion gear 36 mounted in mandrel body 38. The honing mandrel 10 is operated by positioning it in a work surface such as in the work surface 40. This is done when the work engaging members 20, 22, 28 and 30 are in retracted positions. During a honing operation the pinion gear 36 is rotated in the body 38 to move the work engaging members radially outwardly into engagement with the work surface 40, and pressure is maintained on the work engaging members by maintaining rotational force on the pinion gear 36. It is important that the guide assemblies 16 and 18 are able to flex during the honing operaton so that guide members 28 and 30 contact bore 40 with relatively light pressure even when heavy pressure is being applied to the work surface by the honing assemblies. In the usual prior art construction the stone assemblies 12 and 14 are diametrically opposite to each other and the guide assemblies 16 and 18 are likewise diametrially opposite to each other and usually are also at right angles to the stone assemblies. Such a construction has been used for many years but frequently generates undesirable noise in operation. Experience has shown that when guides 28 and 30 do not erode as fast as the honing stones, springs 35 and 37 become compressed thereby preventing the guide assemblies 16 and 18 from flexing which causes substantial objectionable vibration and chatter, and these undesirable conditions become worse as the force on the stone and guide assemblies increases and when the guide assemblies bottom on their support means.

Figure 2:
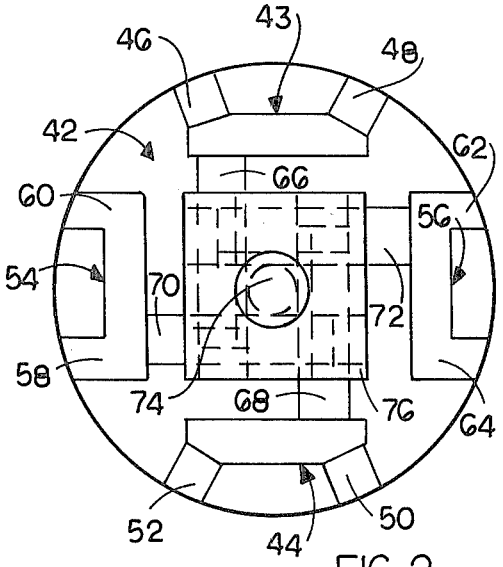
FIG. 2 is a cross-sectional view through another conventional mandrel construction having a different form of pinion driven work engaging honing and guide assemblies mounted thereon.

FIG. 2 shows another mandrel construction 42 in which two opposite hone assemblies 43 and 44 each has two circumferentially spaced stones 46 and 48 and 50 and 52 arranged as shown, and each of the guide assemblies 54 and 56 has two circumferentially spaced work engaging guide members 58 and 60 and 62 and 64 making for an eight work engaging element construction. Each of the four assemblies also has at least two spaced rack gears such as the respective rack gears 66, 68, 70, and 72, and all of the rack gears have similar teeth that mate with the elongated teeth on pinion gear 74 rotatable in mandrel body 76. One of the advantages of the construction 42 as compared to the construction 10 is that by having two work engaging members on each assembly it is able to hone bores that have interruptions in them such as interruptions formed by splines and keyways. However, the construction shown in FIG. 2 also has an important disadvantage in that it is a very noisy construction and this has substantially limited its usefulness. The guide assemblies 54 and 56 in existing constructions are made of one piece and are rigidly affixed to the rack gears 70 and 72. The inability of these assemblies to flex and relieve the pressure with which they contact the bore causes chatter and vibration as occurs in the FIG. 1 construction when the guide assemblies are fully compressed and/or the guide assemblies bottom on their supports.

Figure 3:
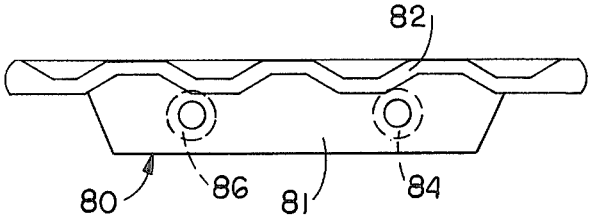
FIG. 3 is a top plan view of a replaceable work engaging guide member for attaching to a masterholder portion of a guide assembly constructed according to the present invention.
Figure 4:
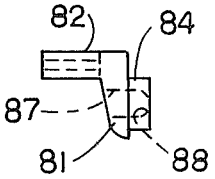
FIG. 4 is a right end view of the replaceable guide member of FIG. 3.
Figure 10:
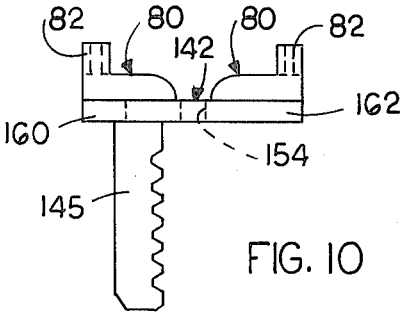

FIG. 3 shows the top view of a perishable, replaceable guide member 80 of the type used on the improved construction. The member 80 includes a support portion 81 with an upstanding work engaging portion 82 projecting from one surface thereof and adjacent to one side edge. The guide 80 also has two or more integral spaced tubular portions shown as tubular portions or lugs 84 and 86 extending from the surface opposite from the work engaging portion 82. FIG. 4 shows the inner surface of each lug for illustrative purposes formed by a cylindrical surface portion 87 and a tapered surface portion 88. The guide member 80 is constructed of a material such as zinc which is relatively non-abrasive and is more likely to slide on a work surface than to abrade it, and the member 80 is adapted to be mounted on a masterholder and several forms of masterholders to which the subject guide 80 can be mounted will be described.

The construction of the masterholder is important to the present invention. When the guide 80 is attached to the masterholder a tool having a threaded end portion (not shown) will be threaded through the hole portions 87 and 88 in the lugs 84 and 86 to flare the reduced diameters portions 88 thereof outwardly to make the attachment to the masterholder. The details of such attachment means are set forth and fully described in copending Sunnen U.S. patent application Ser. No. 314,856, filed Oct. 26, 1981 and assigned to Applicant's assignee. The support portion 81 of the guide 80 is shown as being flat on one of its opposite surfaces and this surface is positioned adjacent to the masterholder on which it is mounted. The other opposite surface of the support portion 81 may have a different contour and is shown as being rounded along one edge thereof.

The upstanding work engaging portion 82 of the guide 80 is shown having a wavy construction to reduce the amount of material necessary to form the guide. It is contemplated, however, that the upstanding work engaging portion 82 could be made of an elongated member with parallel sides or to have some other configuration along the length thereof without departing from the invention. The guide 80 as indicated is constructed of a material such as zinc although other relatively non-abrasive materials such as bronze, brass, and certain plastics can be used.

Figure 5:
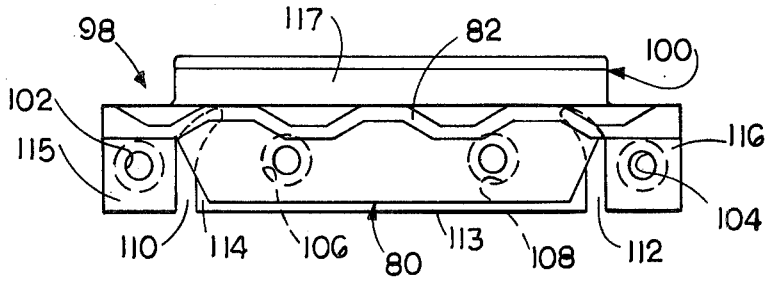
FIG. 5 is a top plan view of a guide assembly constructed according to one embodiment of the present invention.

FIG. 5 is a top plan view showing a guide assembly 98 with the guide 80 mounted on one embodiment 100 of a masterholder. The masterholder 100 has two spaced holes 102 and 104 located adjacent to opposite ends thereof into which reduced diameter end portions of similar rack gear members 103 are positioned and riveted or peened to retain them firmly attached to the masterholder 100. The rack gear members 103 have rack gear teeth 105 formed on corresponding sides thereof for engaging a pinion gear in a honing mandrel such as the pinion gear 36 shown in FIG. 1.

The masterholder 100 also has other spaced holes 106 and 108 extending therethrough as shown in FIG. 5. The holes 106 and 108 are sized, shaped and positioned to receive the respective lugs 84 and 86 on the guide 80 to facilitate attaching the guide 80 to the masterholder 100. The particular form of the masterholder 100 shown in FIG. 5 includes spaced relief slots or weakened areas 110 and 112 formed extending transversely inwardly from side edge 113. The slots 110 and 112 are included to enable portions of the elongated masterholder 100 to flex or to be able to deflect angularly relative to each other. This includes the portion 114 which is the portion that extends between the slots 110 and 112 and the other portions of the masterholder 100 including end portions 115 and 116. The slots increase the ability of the portion 114 of the masterholder 100 to bend or flex relative to the rest of the master holder 100. The particular form and/or shape of the slots 110 and 112 including their widths, lengths, spacing and configuration can be varied considerably in order to achieve a desired flexibility between the different portions of the masterholder 100 as stated. In the particular embodiment shown in FIG. 5, the elongated portion 117 is also shown curved or angled relative to the rest of the masterholder and this may be helpful in some cases to prevent fatiguing of the masterholder 100 in the area where the flexing occurs and to prevent longitudinal bending of the masterholders 100 between the holes 106 and 108 which would cause the lugs 84 and 86 to loosen. Most of the flexing in the construction shown in FIG. 5 will take place in the relatively narrow areas between the ends of the slots 110 and 112 and the adjacent end portions 115 and 116 where the narrowest parts of the masterholder are located. Thus it can be seen that with the construction shown in FIG. 5, the guide member 80 which is fixedly attached to the portion 114 is able to flex or move angularly relative to the portions 115 and 116, and also relative to the rack gears 103 which are connected to the respective portions 115 and 116 and are used to radially position and support the guide assembly during operation of the honing mandrel on which it is installed.

Figure 6:
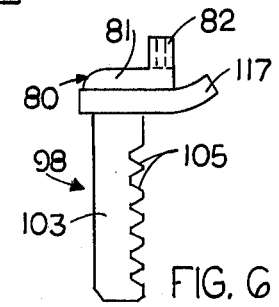
FIG. 6 is a right end view of the guide assembly of FIG. 5.

FIG. 6 is an end view of the guide assembly 98 shown in FIG. 5 and is included for added clarity and understanding of the relationship of the components.

Figure 7:
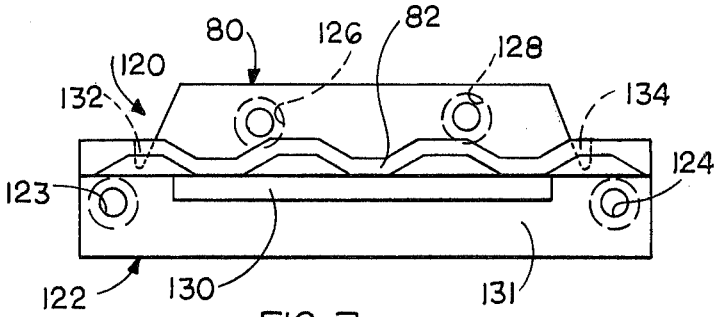
FIG. 7 is a top view showing another embodiment of a guide assembly constructed according to the present invention.

FIG. 7 shows another embodiment 120 of the guide assembly and particularly of the masterholder portion 122 thereof. The masterholder 122 has holes 123 and 124 near opposite ends thereof to which similar rack gears 125 are attached in a manner similar to that described above. Other holes 126 and 128 are also formed in the masterholder 122 at spaced locations and in positions to cooperatively receive the lug portions 84 and 86 of the guide member 80. However, in the construction shown in FIG. 7 the guide member 80 is mounted on the opposite or outboard portion 129 of the masterholder 122 rather than on the inboard portion 114 as in the construction shown in FIGS. 5 and 6. Also, and importantly, the masterholder 122 has an elongated slot or weakened area 130 formed extending therealong at an intermediate location transversely in position between the inboard and outboard portions 131 and 129 of the masterholder 122. In the construction 122 the position of the guide 80 has been reversed or turned around by 180° relative to its position in the construction 98 of FIGS. 5 and 6 so that upstanding work engaging portion 82 is at or near the same location on the masterholder 122 relative to the rack gears 125 as it was in the construction shown in FIG. 5 relative to the rack gears 103. The inboard and outboard portions 131 and 129 of the masterholder 122 are able to flex or bend under load conditions relative to each other in order to enable the work engaging member 82 to deflect backwardly from the direction of rotation under pressure when engaged with a work surface. If further flexing action is required between the portions 131 and 129 of the masterholder 122 on opposite sides of the slot 130 then additional means such as the notches 132 and 134 can be provided to further reduce the cross-sectional area of the masterholder 122 that undergoes the flexing. This is because the distance between the ends of the slot 130 and the closest adjacent edges of the masterholder 122 is one of the main things that determines the flexibility of the masterholder 122 including the ability of the inboard and outboard portions to move relative to each other. Also, by having the notches 132 and 134 formed in the masterholder at the locations shown to some extent reduces the possibility for the outboard portion 129 of the masterholder 122 which is the portion to which the guide 80 is attached to warp or to bend into other than a flat condition. This is desirable to prevent straining of the connections between the guide 80 and the masterholder 122. Therefore, the optional notches 132 and 134 not only effect the resiliency or bendability of the masterholder but also help to prevent the guide 80 from coming loose during operation.

Figure 8:
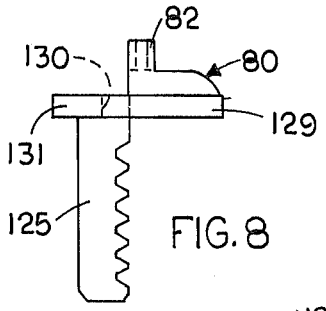
FIG. 8 is a right end view of the guide assembly of FIG. 7.

FIG. 8 is an end view of the guide assembly 120 of FIG. 7 and is included to further facilitate an understanding of the relationship between the components.

Figure 9:
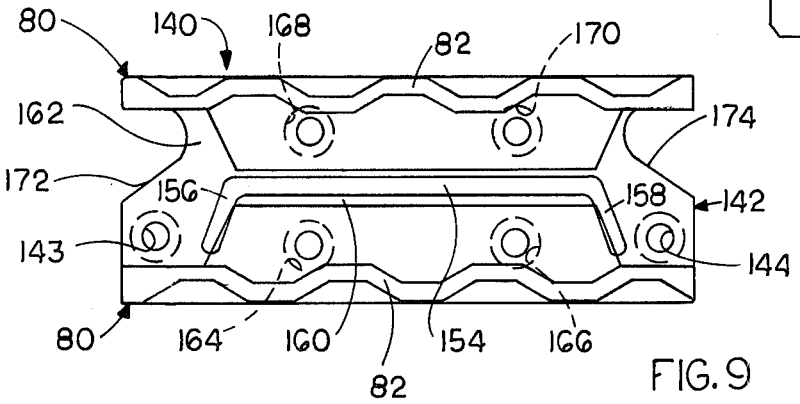
FIG. 9 is a top plan view of yet another guide assembly constructed according to the present invention; and, FIG. 10 is a right end view of the guide assembly of FIG. 9.

FIG. 9 shows another embodiment 140 of a guide assembly incorporating the teachings of the present invention wherein two similar or identical guide members such as the guide members 80 are installed on the same masterholder 142. In the assembly 140 the masterholder 142 has spaced holes 143 and 144 which are provided for attaching rack gears 145 in the manner described above. The masterholder 142 also has an elongated slot or weakened portion 154 which has angularly related end portions 156 and 158 which divides the masterholder into substantially parallel inboard and outboard portions 160 and 162. The inboard portion 160 is in alignment with where the rack gears 145 are attached and the outboard portion 162 is parallel to the inboard portion 160. The inboard and outboard portions 160 and 162 each has spaced holes 164 and 166 and 168 and 170 which are sized and positioned to cooperatively receive lugs similar to the spaced tubular lugs 84 and 86 shown in FIGS. 3 and 4. These holes are provided for attaching the respective guide assemblies 80 thereto. However, in the construction shown in FIG. 9 one of the guide assemblies is mounted with its work engaging portion 82 located extending along the free side edge of the inboard portion 160 of the masterholder 142 and the other guide 80 is mounted with its upstanding work engaging portion 82 mounted extending along the opposite free side edge of the outboard portion 162 of the masterholder. This means that the work engaging portions 82 on the two guides 80 mounted on the masterholder 142 will be in parallel relation but will be positioned extending along opposite sides of the masterholder. Note also that the work engaging portions 82 of the two guides 80 are able to flex independently of each other so that under load against a work surface the respective opposite edge portions of the masterholder 142 will flex in the same direction.

The masterholder 142 also has cutouts 172 and 174 formed in the opposite ends thereof as shown, and these cutouts are located at positions corresponding to the positions for the rack gears such as the rack gears 145 associated with a similar guide assembly located on the opposite side of a honing mandrel. The cutouts or notches 172 and 174 provide clearance for the rack gears on the opposed guide assembly so that when the honing mandrel is in its retracted or collapsed condition the rack gears on both opposite assemblies can extend into the similar notches 172 and 174 on each guide assembly to increase the range of possible radial adjustment of the mandrel. In the construction of FIG. 9, as in the other constructions, the slot or groove 154 is provided to facilitate flexing or relative movement between the inboard and outboard portions 160 and 162 and rack gears 145 attached to the masterholder 142.

In all forms of the present construction the masterholders are constructed to enable some flexing of the guide members relative to the rack gears which support the masterholders on which they are mounted. The amount of flexing and the resiliency of the masterholders can be varied considerably as required. This can be done by changing the thickness of the masterholder and by changing the size, space, depth and location of the slots or grooves or other weakening means formed therein between the inboard and outboard portions thereof. It has been found that a guide assembly constructed according to the present invention will substantially reduce the noise and vibration of a honing mandrel such as honing mandrels having work engaging honing and guide assemblies moveable radially under control of a centrally located pinion gear such as in the constructions shown in FIGS. 1 and 2.

Thus there has been shown and described several embodiments of a masterholder for supporting a work engaging guide member on a honing mandrel, which masterholder can provide resilient support for one or more work engaging guide members mounted thereon, which masterholders fulfill all of the objects and advantages sought therefor. It will be apparent to those skilled in the art, however, that many changes, modifications, variations, and other uses and applications for the subject masterholders are possible, and all such changes, modifications, variations, and other uses and applications which do not depart from the spirit and scope of the invention are deemed to be covered by the invention which is limited only by the claims which follow.

What is claimed is:

1. A guide assembly for a honing mandrel comprising an elongated member having opposite surfaces and spaced side edges, means including slot means formed in the elongated member weakening the elongated member to form the member into adjacent first and second elongated portions on opposite sides of the slot means which portions are capable of relative angular movement therebetween, at least two elongated parallel rack gears having corresponding ends connected at spaced locations to extend perpendicularly from one of the opposite surfaces of said first portion of the elongated member, an elongated work engaging member having a first portion positioned adjacent to the second position of the elongated member and a second portion extending outwardly from the first portion for engaging a work surface to be honed, and means connecting the work engaging member to the elongated member.

2. In a honing mandrel having opposite sets of work engaging assemblies including an opposed set of honing assemblies and an opposed set of guide assemblies and rack and pinion gears for moving the assemblies radially to expand and contract the honing diameter, the improvement comprising similar guide assemblies each having a work engaging guide member and means for supporting the work engaging guide member, said support means on each guide assembly including a support member formed of relatively hard but somewhat resilient material having opposed surfaces and connected first and second portions, said support member being weakened between the first and second portion to facilitate limited relative angular movement therebetween, at least two spaced rack gear members attached to extend in parallel relation perpendicularly from one of the opposed surfaces of the first portion of the support member, and at least one work engaging guide member attached to the other opposed surface of the second portion of the support member, the second of said connected portions of the elongated member extending at least in part between where the rack gear members are connected to the first portion.

3. In a honing mandrel having opposed sets of work engaging assemblies including an opposed set of honing assemblies and an opposed set of guide assemblies and cooperating rack and pinion gear means on the mandrel and the assemblies for moving the assemblies radially to expand and contract the honing diameter of the mandrel, the improvement residing in the construction of the guide assemblies each comprising a work engaging guide member and means for supporting the work engaging guide member, said support means on each guide assembly including an elongated support member having opposed surfaces and elongated connected first and second portions and means therebetween which weaken the support member to facilitate limited relative angular movement between the first and second portions, at least two spaced rack gears attached extending perpendicularly from the first connected portion of the elongated support member and from one of the opposed surfaces thereof, and at least one work engaging guide member attached to the second of the connected portions of the elongated support member on the other opposed surface thereof whereby the second portion of the elongated support member and the work engaging guide member attached thereto are able to flex relative to said first portion of the elongated support member.

4. A guide assembly for use on a honing mandrel having opposed sets of honing and guide assemblies each supported and moved by rack gears engageable with a pinion gear, each of said guide assemblies including an elongated support member having opposed surfaces and spaced side and end edges, spaced elongated rack gears having opposed ends, means connecting corresponding ends of the rack gears to the elongated support member to extend outwardly therefrom in parallel spaced relation from one of the opposed surfaces thereof at locations adjacent to one of the side edges and the respective end edges thereof, first means including elongated means weakening the elongated support member at an intermediate location therealong between the spaced side edges to facilitate portions of the elongated member on opposite sides of the first weakening means to be able to move angularly relative to each other, second means including spaced substantially transversely extending means weakening the elongated member at spaced locations on the support member on one side of the first weakening means and between where the rack gears are connected thereto to form another elongated portion of the support member extending therebetween, said other elongated portion being able to move angularly relative to the rack gears and to the portions of the support member to which the rack gears are connected and independently of the portion of the elongated member on the opposite side of the aforesaid first weakening means, and a separate work engaging guide member attached to the support member on each opposite side of the first weakening means, one of said work engaging guide members extending over the area between the spaced substantially transversely extending second weakening means, said work engaging guide members being attached to the support member on the opposite surface from the rack gears.

5. The guide assembly of claim 4 including openings formed adjacent to the respective end edges of the support member at locations in alignment with the rack gears on a similar guide assembly mounted on the opposite side of the honing mandrel.

6. A guide assembly for a honing mandrel comprising an elongated member having opposite surfaces and spaced side edges, means weakening the elongated member to form the member into adjacent first and second portions capable of limited relative angular movement therebetween, said means weakening including at least two spaced substantially transversely extending slots formed extending inwardly from one of the side edges of the elongated member, at least two elongated parallel rack gears having corresponding ends connected at spaced locations to extend in parallel relation extending perpendicularly from one of the opposite surfaces of said first portion of the elongated member, an elongated work engaging member having a first portion positioned adjacent to the second portion of the elongated member and a second portion extending outwardly from the first portion for engaging a work surface to be honed, and means connecting the work engaging member to the elongated member.

7. The guide assembly of claim 6 wherein the second portion of the elongated member includes a portion that extends at least in part in a plane angularly related to the first portion.

8. The guide assembly of claim 6 wherein the elongated member is formed of steel and the work engaging member is formed of zinc.

9. A guide assembly for a honing mandrel comprising an elongated member having opposite surfaces and spaced side edges, means weakening the elongated member to form the member into adjacent first and second portions capable of limited relative angular movement therebetween, said means weakening including an elongated slot formed extending between the first and second elongated portions of the elongated member along a substantial portion of the length thereof, said slot having transversely extending end portions, at least two elongated parallel rack gears having corresponding ends connected at spaced locations to extend in parallel relation extending perpendicularly from one of the opposite surfaces of said first portion of the elongated member, an elongated work engaging member having a first portion positioned adjacent to the second portion of the elongated member and second portion extending outwardly from the first portion for engaging a work surface to be honed, and means connecting the work engaging member to the elongated member.

10. The guide assembly of claim 9 including a second elongated work engaging member similar in construction to the aforesaid elongated work engaging member and means connecting the second work engaging member to the elongated member at a second location thereon in spaced relation to the aforesaid work engaging member and other means weakening the elongated member to enable the second location thereon and the work engaging member attached thereto to move independently of and in the same direction as the aforesaid work engaging member.

11. The guide assembly of claim 10 wherein the work engaging portion of the second work engaging member is parallel to the work engaging portion of the aforesaid work engaging member.

* * * * *

UNITED STATES PATENT OFFICE

CERTIFICATE OF CORRECTION

Patent No. 4,486,983 Dated December 11, 1984

Inventor(s) Robert M. Sunnen and Duane W. Woltjen

It is certified that error appears in the above-identified patent and that said Letters Patent are hereby corrected as shown below:

Column 7, line 45, "position" should be --portion--.

Signed and Sealed this

Thirtieth Day of April 1985

[SEAL]

*Attest:*

DONALD J. QUIGG

*Attesting Officer* *Acting Commissioner of Patents and Trademarks*